US009469943B2

(12) United States Patent
Ortiz Rivas

(10) Patent No.: US 9,469,943 B2
(45) **Date of Patent: *Oct. 18, 2016**

(54) LEVELING RAIL JOINTS WITH PLANAR SURFACE OBLIQUE SUPPORT

(71) Applicant: Arturo A. Ortiz Rivas, Monterrey (MX)

(72) Inventor: Arturo A. Ortiz Rivas, Monterrey (MX)

( * ) Notice: Subject to any disclaimer, the term of this patent is extended or adjusted under 35 U.S.C. 154(b) by 107 days.

This patent is subject to a terminal disclaimer.

(21) Appl. No.: 14/334,774

(22) Filed: Jul. 18, 2014

(65) Prior Publication Data

US 2014/0326799 A1 Nov. 6, 2014

Related U.S. Application Data

(63) Continuation of application No. 12/852,006, filed on Aug. 6, 2010, now Pat. No. 8,915,452.

(51) Int. Cl.
*E01B 11/16* (2006.01)
*E01B 11/08* (2006.01)

(52) U.S. Cl.
CPC ..... *E01B 11/16* (2013.01); *E01B 11/08* (2013.01)

(58) Field of Classification Search
CPC ..... B60M 5/00; B60M 5/02; E01B 11/00; E01B 11/02; E01B 11/08; E01B 11/16
USPC ..... 238/151, 159–161, 243, 246–248, 336
See application file for complete search history.

(56) References Cited

U.S. PATENT DOCUMENTS

| | | | | |
|---|---|---|---|---|
| 862,645 | A | 8/1907 | Lewis | |
| 1,072,866 | A | 9/1913 | McEvoy et al. | |
| 1,089,058 | A | 3/1914 | Keller | |
| 1,201,815 | A | 10/1916 | Forbes | |
| 1,335,385 | A | 3/1920 | Mitchell | |
| 1,369,697 | A | 2/1921 | Mulzer | |
| 1,395,136 | A | 10/1921 | Pleshe | |
| 1,639,620 | A | 8/1927 | Troup | |
| 1,871,977 | A | 8/1932 | Frickey | |
| 2,161,340 | A | 6/1939 | Disbrow | |
| 2,531,656 | A | 11/1950 | Thonger | |
| 2,793,816 | A | 5/1957 | Lansing | |
| 3,199,855 | A | 8/1965 | Miller | |
| 4,386,736 | A | 6/1983 | Benkler et al. | |
| 4,466,570 | A | 8/1984 | Howard | |
| 4,630,772 | A | 12/1986 | Watanabe et al. | |
| 5,503,331 | A | 4/1996 | Urmson, Jr. et al. | |
| 5,765,785 | A | 6/1998 | Ortiz Rivas | |
| 6,119,988 | A | 9/2000 | Ortiz Rivas | |
| 6,254,038 | B1 | 7/2001 | Ortiz Rivas | |
| 6,276,243 | B1 | 8/2001 | Jenkins | |
| 6,276,643 | B1 | 8/2001 | Ortiz Rivas | |
| 8,915,452 | B2 * | 12/2014 | Ortiz Rivas | E01B 11/08 238/159 |
| 2009/0302125 | A1 | 12/2009 | Urmson, Jr. et al. | |
| 2010/0090018 | A1 | 4/2010 | Akhtar et al. | |

* cited by examiner

*Primary Examiner* — Robert McCarry, Jr.
(74) *Attorney, Agent, or Firm* — Bracewell LLP

(57) ABSTRACT

A joint between connected ends of two rails of different height is provided with a connector/juncture bar member which is configured to fit with and engage corresponding surfaces formed on the rails when the rails are connected together. The joint so formed is one with increased strength, with ease and accuracy of alignment during assembly.

8 Claims, 3 Drawing Sheets

LEVELING RAIL JOINTS WITH PLANAR SURFACE OBLIQUE SUPPORT

CROSS REFERENCE TO RELATED APPLICATIONS

The present invention is a continuation of my co-pending U.S. Patent Application entitled "Leveling Rail Joints With Oblique Support", Ser. No. 12/852,006, filed Aug. 6, 2010, priority for which is claimed pursuant to 35 U.S.C. §120.

BACKGROUND OF THE INVENTION

1. Field of the Invention

The present invention relates to rail joints for railroad track.

2. Description of the Related Art

A railroad way is formed by joining two sets of parallel rails together, each set of rails formed of a number of rails connected lengthwise at their adjoining aligned ends. When one of the installed rails required replacement due to breakage, damage or completion of useful service life, the old installed rail has been replaced with a replacement or substitute rail, which could be a new or a used rail. In such cases, the replacement or substitute rail has often been a different height than that of the connecting rail to which connection was made.

So far as is known, it has been the practice to maintain the base portions of the replacement rail and the remaining rail of the original joint at a common level in the new joint being formed. This resulted in the upper surfaces of the head portions of the joined rails being at a different height. In these situations, however, there were impacts and shocks caused when the wheels of the engines and the rolling stock passed over the joint with the rail heads of different height. The repeated application of the resulting impacts so caused resulted in damage to the rails with resulting damage and loss of service life for the rails. There were also possible safety concerns.

SUMMARY OF THE INVENTION

Briefly, the present invention provides new and improved rail track structure formed at adjoining end portions of rails which have differing characteristics. The present invention provides a new and improved leveling joint connector bar for connecting adjoining end portions of rails of different height in a track structure. The adjoining end portions of the rails have an oblique surface formed below a head portion extending inwardly towards a web portion and an oblique surface on a foot portion extending inwardly towards the web portion. The leveling joint connector bar includes an elongate joint body spanning the adjoining end portions of the rails to be joined, and having a number of connector holes formed therein aligned with connector holes in the web portions of the adjoining end portions of the rails to be joined.

The elongate joint body member has an oblique upper surface formed with and extending along the length of the joint body, and the oblique upper surface is machined to conform to and engage with the oblique surface formed below the head portions of the adjoining end portions of the rails to be joined.

The elongate joint body member has an oblique lower surface formed with and extending along the length of a first segment of and conforming to and engaging with the oblique surface formed on the base portion of a first of the two rails to be joined. The elongate joint body member also an oblique lower surface formed with and extending along the length of a second segment of and conforming to and engaging with the oblique surface formed on the base portion of a second of the two rails to be joined.

The oblique upper surface of the elongate joint body member and the oblique lower surface of the first segment of the elongate joint body member are spaced from each a distance corresponding to the height of the first of the two rails to be joined, and the oblique upper surface of the elongate joint body member and the oblique lower surface of the second segment of the elongate joint body member are spaced from each a distance corresponding to the height of the second of the two rails to be joined.

The rail track structure includes a first track and a second segment having a web portion, a base portion and a head portion, the web portions of the first and second track segments having a number of connector holes formed therein for the passage of connectors at their end portions. The head portions of the first and second track segments each have an oblique surface formed below a head portion extending inwardly towards their web portions. The base portions of the first and second track segments also an oblique surface formed on a foot portion extending inwardly towards their web portions.

An elongate connector bar is connected to span and join the adjoining end portions of the first and second track segments being joined, with a number of connector holes formed in the connector bar aligned with the connector holes in web portions of the adjoining end portions of the first and second track segments.

The elongate joint body member has an oblique upper surface formed with and extending along the length of the joint body. The oblique upper surface conforms to and engages with the oblique surface formed below the head portions of the adjoining end portions of the rails. The elongate joint body member has an oblique lower surface formed with and extending along the length of a first segment of and conforming to and engaging with the oblique surface formed on the base portion of a first of the two rails.

The elongate joint body member has an oblique lower surface formed with and extending along the length of a second segment of and conforming to and engaging with the oblique surface formed on the base portion of a second of the two rails to be joined. The oblique upper surface of the elongate joint body member and the oblique lower surface of the first segment of the elongate joint body member are spaced from each a distance corresponding to the height of the first of the two rails. The oblique upper surface of the elongate joint body member and the oblique lower surface of the second of the elongate joint body member are spaced from each a distance corresponding to the height of the second of the two rails.

The present invention provides new and improved leveling rail joints where the fitting, engagement and engagement with the rails being connected at their end portions is made by a set of joint or connector bodies that provide increased strength to the assembly.

BRIEF DESCRIPTION OF THE DRAWINGS

The characteristic details of the present invention are clearly shown in the following description and accompanying figures, which illustrate this and provide points of reference to indicate the same parts in the figures shown.

DETAILED DESCRIPTION OF THE PREFERRED EMBODIMENTS

Figure 1:
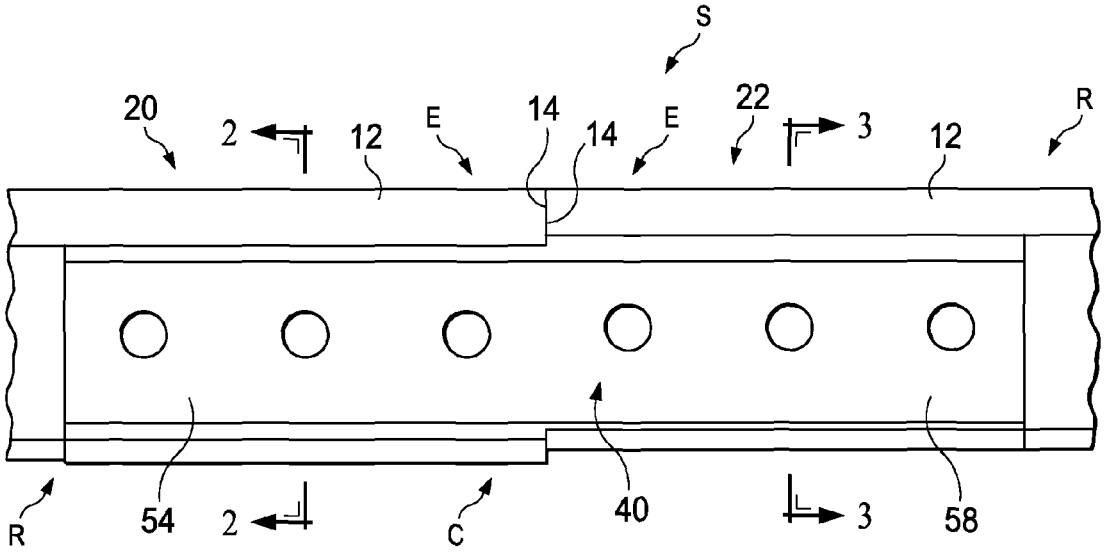
FIG. 1 is a side view of a leveling rail joint according to the present invention for joining rails of different height characteristics.

In the drawings, the letter S designates generally a railroad track structure formed by a leveling rail joint L between a pair of adjacent track components, such as rail sections or segments R whose end portions E are to be joined. As will be set forth below, the adjoining end portions E of rails R which are joined by the leveling rail joint L have differing height characteristics.

Turning first to the rails R, the adjoining end portions E of the rails R to be joined have differing characteristics, in this case a different height. Each of the rails R has a web portion below a head portion 10 downwardly to a foot or base portion 12. The end portions E are brought into engagement along their respective end surfaces 14 in forming the leveling rail joint L, as will be set forth.

Figure 2:
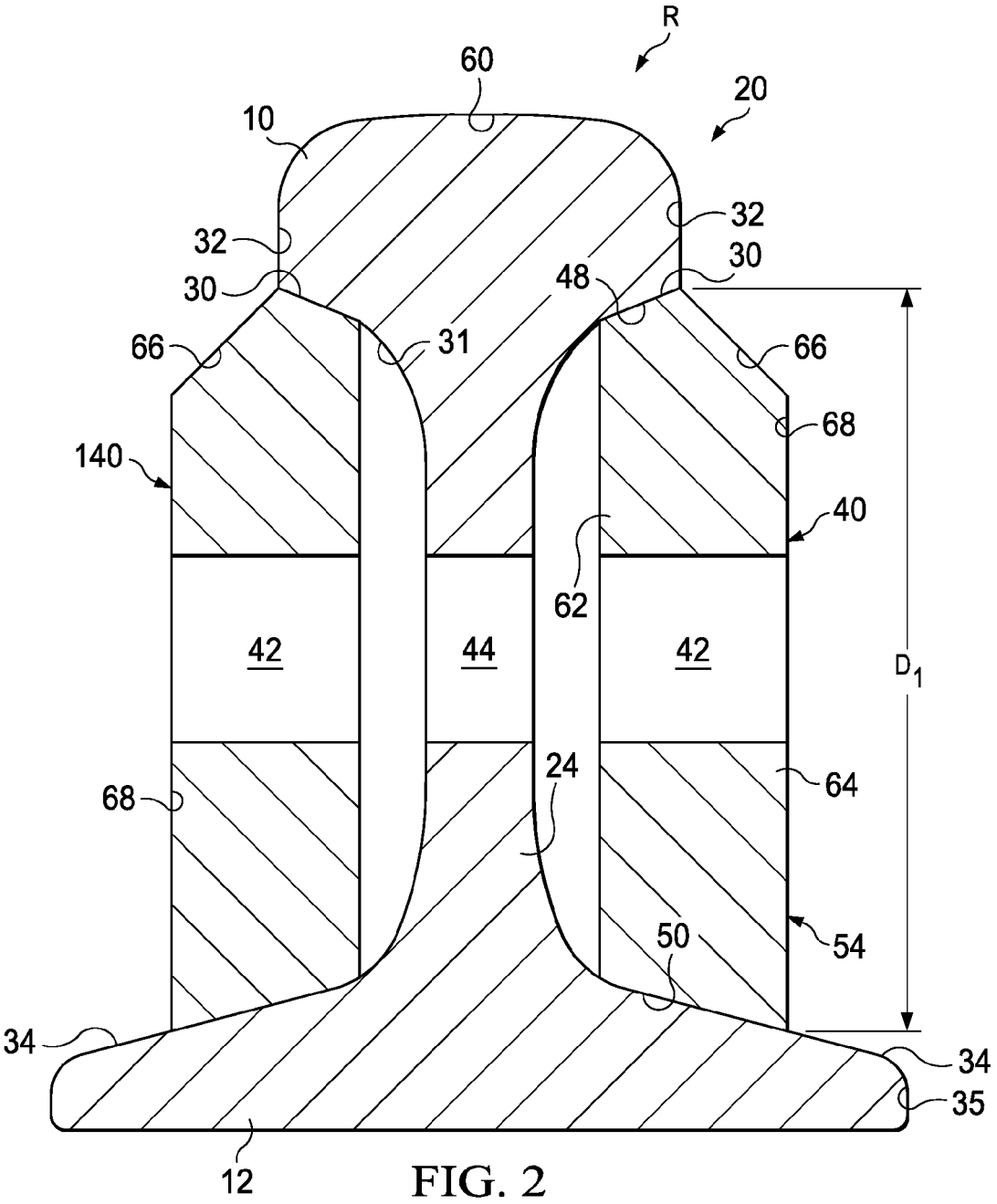
FIG. 2 is a cross-sectional view taken along the lines 2-2 of the leveling rail joint of FIG. 1.
Figure 3:
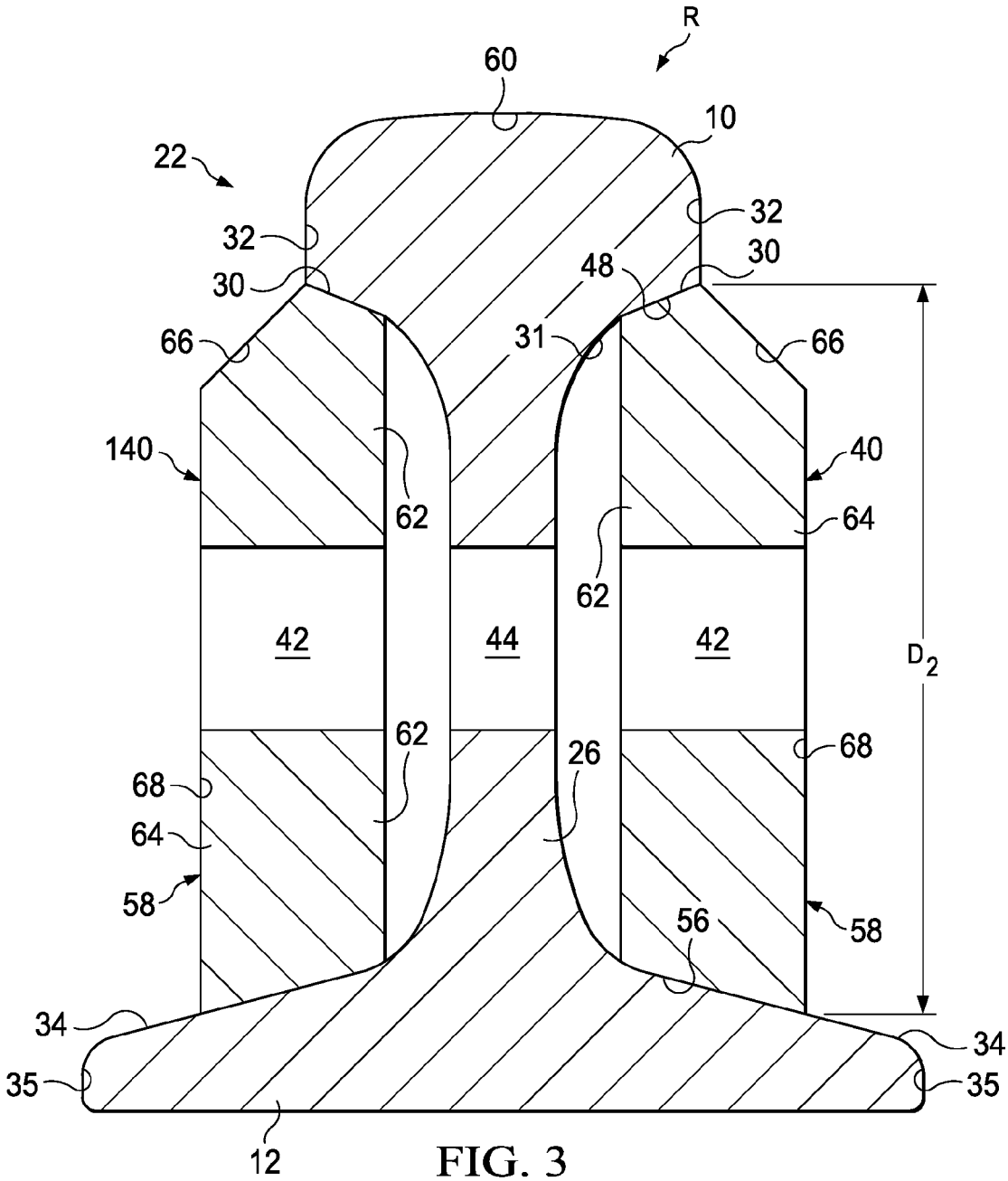
FIG. 3 is a cross-sectional view taken along the lines 3-3 of the leveling rail joint of FIG. 1.

As is evident in FIGS. 2 and 3, a first rail 20 (FIG. 2) of the rails R is of a greater height than a second rail 22 (FIG. 3), due for example to the rails 22 having been in service for a period of time and rail 20 being newer. In some cases, the height difference is also in part due the result of a greater vertical of a web portion 24 of first rail 20 in comparison with web portion 26 of the second rail 22. Typically, the rails 20 and 22 are of like or comparable profile. In other cases, the height of the head portion or the base portion, or both, of the rails R may differ and contribute to the different height characteristics of the rails R to be joined.

Each of the rails R is what is termed a standard rail and includes an oblique or slanting planar surface 30 formed on a lower surface 31 extending inwardly in a downward direction from a side surface 32 on each side of the head portion 10 of the rails R. The oblique surface 30 extends at a slanting or transverse angle with respect to the vertical axis of the rails R. The slope and the angle of surface 31, as well as their extent in the rails R is in accord with appropriate rail industry standards for the particular rails being used based on the services conditions and the like.

Each of the rails R also includes an oblique or slanting planar upper surface 34 formed extending upwardly and inwardly from a side surface 35 of the foot or base portion 12. The oblique surface 30 also extends at a slanting or transverse angle with respect to the vertical axis of the rails R. The slope and the angle of surface 34 and their extent in the rails R is also in accord with appropriate rail industry standards for the particular rails being used based on the services conditions and the like.

The leveling rail joint L according to the present invention is in the form of an elongate joint body 40 of sufficient length to span the adjoining end portions E of the rails R to be joined and provide requisite strength and support in the structure so formed. The length of the joint body 40 and its extent along the adjoining end portions E with which it is mounted are determined by the intended service or usage nature of the rails R and load bearing considerations.

The joint body 40 is formed of suitable strength alloy steel, depending upon the intended load and service usages of the rail structure S. Alloy steel bars are machined with flat planar surfaces to conform and engage corresponding planar surfaces of the rails R, as will be described, to form the joint body 40. The joint body is elongate in the context of being of adequate extent along the rail joint between the rails R to provide adequate strength, support and durability during service life usage. This is determined by rail dimensions, and also intended service or usage nature of the rails, load bearing considerations and other rail design factors.

The joint body 40 has a suitable number of connector holes or ports 42 formed through it along its longitudinal extent. The connector holes 42 are spaced from each other along the joint body 40 at locations aligned with the connector holes 44 in web portions 24 and 26 of the adjoining end portions E of the rails R to be joined. It is preferable that the connector holes 42 be located on center points spaced no more than about four inches from each other along the extent of the joint body 40 for increased strength. If necessary, new connector holes may be formed in the web portions of the rails R according to the location of connector holes 42 in the joint body 40.

The elongate joint body member 40 has an oblique upper surface 48 formed with and extending along the length of the joint body, and the oblique upper surface 48 is machined to conform to and engage with the oblique surface 30 formed below the head portions of the adjoining end portions E of the rails R to be joined.

The elongate joint body member 40 further has an oblique lower surface 50 (FIG. 2) formed with and extending along the length of a first segment 54 to conform to and engage across its surface area with the oblique surface 34 formed on the base portion 12 of the rail 20 to be joined. The elongate joint body member 40 also has an oblique lower surface 56 (FIG. 3) formed with and extending along the length of a second segment 58 to conform to and engage across its surface area with the oblique surface 30 formed on the base portion of the rail 22 to be joined.

Each of the oblique lower surfaces 50 and 56 of the joint body member 40 is also machined to conform to and engage the surfaces 30 on the rails 20 and 22 in forming the leveling rail joint L. Thus, each of the oblique planar surfaces of the joint body member 40 is in contact with a corresponding oblique planar surface on the corresponding rail end portion E to be engaged in forming the leveling rail joint L.

The oblique upper surface 48 of body member 40 and the oblique lower surface 50 of the segment 54 of the elongate joint body member 40 are spaced from each a distance indicated as $D_1$ (FIG. 2) in the drawings, corresponding to the height of the web portion of the rail 20 to be joined. The oblique upper surface 48 of the joint body member 40 and the oblique lower surface 56 of the second segment 58 of body member 40 are spaced from each a distance $D_2$ (FIG. 3) corresponding to the height of the web portion of rail 22 to be joined.

Thus with the rail joint L according to the present invention, the end portions E of the rails R are aligned as a common plane along upper surfaces 60 of the head portions 10. Accordingly, as the wheels of traffic from engines and rolling stock pass over the joined rails, a level surface is present for the wheels to contact. In this way damage to the rails due to wheel impact on the rail joint with different height is substantially reduced with the present invention. In a number of cases, it is desirable to insert a shim or chuck or other support below the base portion of the shorter height rail and on the rail cross-tie as load bearing support for the joint L beneath the shorter height rail.

The joint body 40 takes the form of an inner portion 62 located between the head portion 10 and base 12 of the adjoining end portions E of the rail R inwardly of the side surface 32 of the head 10. The joint body 40 also has a support segment 64 extending outwardly from the side surface 32 of the head portions 10 of the rails R to be joined to provide additional strength to the assembled leveling joint and rail end portions E. The support segment 64 includes a surface 66 extending downwardly away from the juncture of the planar surface 30 and side surface 32 of the head portion of the rail R. The support segment 64 has a vertical outer surface 68 extending downwardly to the outer edge of oblique lower surfaces 50 and 56. The support segment 64 is at least as thick as the inner portion 62 of the joint body member 40 located below the head portion 10 of the rail R, and can be, if desired, as much as 150% thicker is cross-section than the inner portion 62.

The joint body 40 shown in the drawings is configured to be installed on the outer side of rails R at end portions E to form a composite joint for what is known as a left hand joint, where the first rail 20 of greater height than the second rail 22 is to the left of rail 22 when one is facing the centerline of the track. For a right-hand joint, the joint body 40 is located on the inner side of the rails being joined. The joint body 40 between rails 20 and 22 could thus be on either of the parallel rails of a section of track.

In assembling the leveling joint L, the head portions 10 of the rail ends E are brought into contact with each other along their vertical end surfaces 14. Further, the end portions E are aligned so that the upper surfaces 60 of the head portions 10 are aligned in a common horizontal plane as the leveling joint L is being assembled.

In an installed leveling joint L, a second joint body 140 is provided to be installed opposite the joint body 40 on right hand joints, such as an inner side of the rails 20 and 22 where the two such rails are of different height. The joint body 140 has like structural components to the joint body 40, but the relative location of the upper surface 48 and the lower surfaces 50 and 56 of segments 54 and 58 on joint body 140 are reversed from those of joint body 40. Accordingly, the joint body 140 is used on the inner side of a left hand joint and on the outer side of a right hand joint.

The leveling joint bodies 40 and 140 which are installed on opposite sides of end sections E of a rail joint according to the present invention are manufactured so that dimensions $D_1$ and $D_2$ correspond to the height difference between the taller or newer rail 20 and the shorter or worn rail 22. The leveling joint bodies 40 and 140 thus have corresponding height dimensions to the difference in height between rails being joined, and the rails R have the same level at their joined end portions E along a level upper surface 60 at their juncture.

The leveling rail joints according to the present invention achieve increased strength in the assembled structure. The assembled joint bodies in place on the rail ends form a solid unitary structure. This structure functions is achieved as an assembly of several engaged pieces with their aligned contacting surfaces. However, should the need arise one of the structural components of the leveling rail joint can be readily changed in a short time for maintenance or replacement.

The leveling rail joints in accordance with the present invention enhance the strength of the rail and joint since the matching and engagement of the joint bodies with the corresponding surfaces on the rail ends cause the joint bodies to function in effect as two additional webs to the rail.

The leveling rail joints of the present invention provide accuracy in the vertical dimensions so that the heads of both rails have the same level at the upper part of the rail heads, making passage of the train wheels relatively noise free and without impact due to a change in height at the rail joint. The leveling rail joints also provide accuracy in the horizontal dimensions so that the connector bolts when installed compress the structural components of the joint with increased strength comparable to that of a solid, unitary piece. The leveling joints according to the present invention in effect provide an additional two web portions in the track structure S in the area of joined rail end portions.

With the leveling rail joints of the present invention, dips or gaps are not formed between the adjoined end portions of the rails R, so that impact on or movement of rails on passage of wheels is significantly diminished. This in turn affords fewer maintenance needs, safer operation and cost savings.

Having described the invention above, various modifications of the techniques, procedures, material and equipment will be apparent to those in the art. It is intended that all such variations within the scope and spirit of the appended be embraced thereby.

What is claimed is:

1. A joint connector bar for connecting adjoining end portions of rails of different height in a track structure, the adjoining end portions of the rails each having oblique surfaces, the oblique surfaces of the adjoining end portions of the rails including: an upper slanting oblique surface formed below a head portion of the rails extending inwardly as a slanting planar surface downwardly towards a web portion of the rails, and a lower planar oblique surface formed sloping upwardly on a foot portion and extending inwardly towards the web portion of the rails, the leveling joint connector bar comprising:

a joint body member to span the adjoining end portions of the rails to be joined and having a number of connector holes formed therein aligned with connector holes in the web portions of the adjoining end portions of the rails to be joined;

the joint body member having a slanting planar oblique upper surface formed with and extending along the length of the joint body, the slanting planar oblique upper surface of the joint body member being machined to conform to and engage along its extent with the inwardly slanting upper planar oblique surfaces beginning at a lower end of a side wall below the head portions along their inward extent towards the web portions of the adjoining end portions of the rails to be joined;

the joint body member having an upwardly sloping planar oblique lower surface formed with and extending along the length of a first segment of the joint body member and being machined to conform to and engage with the upwardly sloping planar oblique surface formed on the base portion of a first of the two rails to be joined;

the joint body member having an upwardly sloping planar oblique lower surface formed with and extending along the length of a second segment of the joint body member and being machined to conform to and engage with the upwardly sloping planar oblique surface formed on the base portion of a second of the two rails to be joined;

the slanting planar oblique upper surface of the joint body member and the upwardly sloping planar oblique lower surface of the first segment of the joint body member being spaced from each other along the first segment of the joint body member a distance corresponding to the height of the web portion of the first of the two rails to be joined; and the slanting planar oblique upper surface of the joint body member and the upwardly sloping planar oblique lower surface of the second segment of the joint body member being spaced from each other along the second segment of the joint body member a distance corresponding to the height of the web portion of the second of the two rails to be joined.

2. The joint connector bar of claim 1, wherein the joint body member has a support segment extending outwardly from the lower end of the side wall surface of the head portions of the adjoining end portions of the rails to be joined to provide additional strength to the assembled joint.

3. The joint connector bar of claim 1, wherein the slanting planar oblique upper surface of the joint body member conforms to and engages along its inward extent with the inwardly slanting upper planar oblique surface beginning at the lower end of the side wall below the head portions along its extent to the web portion of the adjoining end portions of the rails to be joined.

4. A rail track structure formed at adjoining end portions of rails have differing characteristics, comprising:

a first track portion and a second track portion, each having a web portion, a base portion and a head portion, the web portions of the first and second track portions having a number of connector holes formed therein for the passage of connectors at their end portions, the first and second track portions being of different height from each other;

the first and second track portions each having upper slanting oblique surfaces formed below the head portions thereof, the upper slanting oblique surfaces extending inwardly as slanting planar surfaces slanting downwardly towards the web portions of the track portions;

the first and second track portions each further having a lower planar oblique surface formed sloping upwardly on a foot portion and extending inwardly towards the web portion thereof;

a joint body member to span the adjoining end portions of the first and second track segments to be joined and having a number of connector holes formed therein aligned with connector holes in web portions of the adjoining end portions of the first and second track segments;

the joint body member having a slanting planar oblique upper surface formed with and extending along the length of the joint body, the slanting planar oblique upper surface of the joint body member being machined to conform to and engage along its extent with the inwardly extending upper planar oblique surfaces beginning at a lower end of a side wall below the head portions along their inward extent towards the web portions of the adjoining end portions of the rails;

the joint body member having an upwardly sloping planar oblique lower surface formed with and extending along the length of a first segment of the joint body member and being machined to conform to and engage with the upwardly sloping planar oblique surface formed on the base portion of a first of the two rails;

the joint body member further having an upwardly sloping planar oblique lower surface formed with and extending along the length of a second segment of the joint body member and being machined to conform to and engage with the upwardly sloping planar oblique surface formed on the base portion of a second of the two rails;

the slanting planar oblique upper surface of the joint body member and the lower planar oblique surface of the first segment of the joint body member being spaced from each a distance corresponding to the height of the web portion of the first of the two rails; and the slanting planar oblique upper surface of the joint body member and the lower planar oblique surface of the second segment of the joint body member being spaced from each a distance corresponding to the height of the web portion of the second of the two rails.

5. The rail track structure of claim 4, wherein the joint body has a support segment extending outwardly from the lower end of the side wall surface of the head portions of the adjoining end portions of the rails to be joined to provide additional strength to the assembled joint.

6. The rail track structure of claim 4, wherein the joint body member is located on a first side of the adjoining end portions of the first and second track segments, and further including:

a second joint body member bar mounted on an opposite side of the adjoining end portions of the first and second track portions from the first side to span the adjoining end portions of the first and second track segments to be joined and having a number of connector holes formed therein aligned with connector holes in the web portions of the adjoining end portions of the first and second track segments to be joined;

the second joint body member bar having a slanting planar oblique upper surface formed with and extending along the length of the joint body, the slanting planar oblique upper surface of the second joint body member being machined to conform to and engage along its extent with the inwardly slanting upper planar oblique surfaces beginning at a lower end of a side wall below the head portions along their inward extent towards the web portions of the adjoining end portions of the rails;

the second joint body member having an upwardly sloping planar oblique lower surface formed with and extending along the length of a first segment of the second joint body member and being machined to conform to and engage with the upwardly sloping planar oblique surface on the base portion of the first of the two rails;

the second joint body member further having an upwardly sloping planar oblique lower surface formed with and extending along the length of a second segment of the second joint body member and being machined to conform to and engage with the upwardly sloping planar oblique surface formed on the base portion of the second of the two rails;

the slanting planar oblique upper surface of the second joint body member and the lower planar oblique surface of the first segment of the joint body member being spaced from each a distance corresponding to the height of the web portion of the first of the two rails; and the slanting planar oblique upper surface of the second joint body member and the lower planar oblique surface of the second segment of the joint body member being spaced from each a distance corresponding to the height of the web portion of the second of the two rails.

7. The rail track structure of claim 6, wherein the slanting planar oblique upper surfaces of the first and second joint body members conform to and engage along their full inward extent with the inwardly slanting upper planar oblique surfaces beginning at the lower end of the side walls below the head portions, and along their extent to the web portions of the adjoining end portions, of the rails to be joined.

8. The rail track structure of claim 4, wherein the slanting planar oblique upper surface of the joint body member conforms to and engages along its full inward extent with the inwardly slanting upper planar oblique surface beginning at the lower end of the side wall below the head portions, and along its extent to the web portions of the adjoining end portions of the rails to be joined.

* * * * *